United States Patent [19]

Kanno

[11] Patent Number: 5,069,174

[45] Date of Patent: Dec. 3, 1991

[54] FUEL SUPPLYING DEVICE FOR MARINE PROPULSION ENGINE

[75] Inventor: Isao Kanno, Hamamatsu, Japan

[73] Assignee: Sanshin Kogyo Kabushiki Kaisha, Hamamatsu, Japan

[21] Appl. No.: 502,544

[22] Filed: Mar. 30, 1990

[30] Foreign Application Priority Data

Mar. 30, 1989 [JP] Japan ..... 1-78903

[51] Int. Cl.[5] ..... F02D 43/00; F02N 11/08

[52] U.S. Cl. ..... 123/179.16; 123/198 DC; 123/179.5

[58] Field of Search ..... 123/179 G, 179 L, 180 E, 123/198 DB, 198 DC, 179 BG

[56] References Cited

U.S. PATENT DOCUMENTS

| | | | |
|---|---|---|---|
| 3,618,581 | 11/1971 | Simonet | 123/198 DB |
| 3,706,444 | 12/1972 | Masaki et al. | 123/180 E |
| 4,150,654 | 4/1979 | Hetizman et al. | 123/179 L |
| 4,338,896 | 7/1982 | Papasideris | 123/198 DB |
| 4,515,125 | 5/1985 | Buck et al. | 123/198 DB |

*Primary Examiner*—Andrew M. Dolinar

*Attorney, Agent, or Firm*—Ernest A. Beutler

[57] ABSTRACT

Two embodiments of arrangements for precluding the discharge of fuel to an engine when its kill switch is enabled and the starter is operated. One embodiment relates to a fuel injected system and the other embodiment relates to a carbureted system.

9 Claims, 4 Drawing Sheets

FUEL SUPPLYING DEVICE FOR MARINE PROPULSION ENGINE

BACKGROUND OF THE INVENTION

This invention relates to a fuel supplying device for a marine propulsion engine and more particularly to an improved fuel system for an engine that prevents flooding under certain abnormal starting conditions.

Many engines and particularly those embodying magneto type ignition systems require a kill switch so as to stop the engine from running. As is well known, the kill switch generally grounds or disables the ignition circuit and will stop a spark ignited engine from running. However, such kill switches are normally on/off switches and frequently the operator will forget to disable the kill switch when he attempts to restart the engine.

When the engine is cranked with the kill switch still enabled, then it will, of course, be impossible to start the engine. As a result, the engine will become flooded with fuel. Once the operator discovers his mistake and disables the kill switch, it still will be very difficult to start the engine due to the flooded condition. This problem is particularly acute where the engine employs a further enrichment system for providing additional fuel during starting. Even if the operator realizes his mistake early in the starting operation, the combination of the unnecessary cranking while the kill switch has still been enabled and the subsequent time required to start the engine once the error is corrected will deplete the battery.

It is, therefore, a principal object of this invention to provide an improved fuel system for an engine and particularly the type of engine having a kill switch wherein starting of the engine will be enabled.

It is a further object of this invention to provide an improved starting system for an engine having a kill switch wherein the supply of fuel to the engine is stopped during cranking in the event the kill switch is enabled.

It is a further object of this invention to provide an improved starting system for an internal combustion engine of the type having a kill switch wherein the battery power is saved and starting is enabled in the event of operator error.

SUMMARY OF THE INVENTION

This invention is adapted to be embodied in an engine having a starter for cranking the engine for starting, a fuel supply system for supplying fuel to the engine for its running and a kill switch for stopping the engine. In accordance with the invention, means are provided for precluding the discharge of fuel from the fuel supply system when the starter is operated and the kill switch is in its engine stopping condition.

DETAILED DESCRIPTION OF THE PREFERRED EMBODIMENTS OF THE INVENTION

Figure 1:
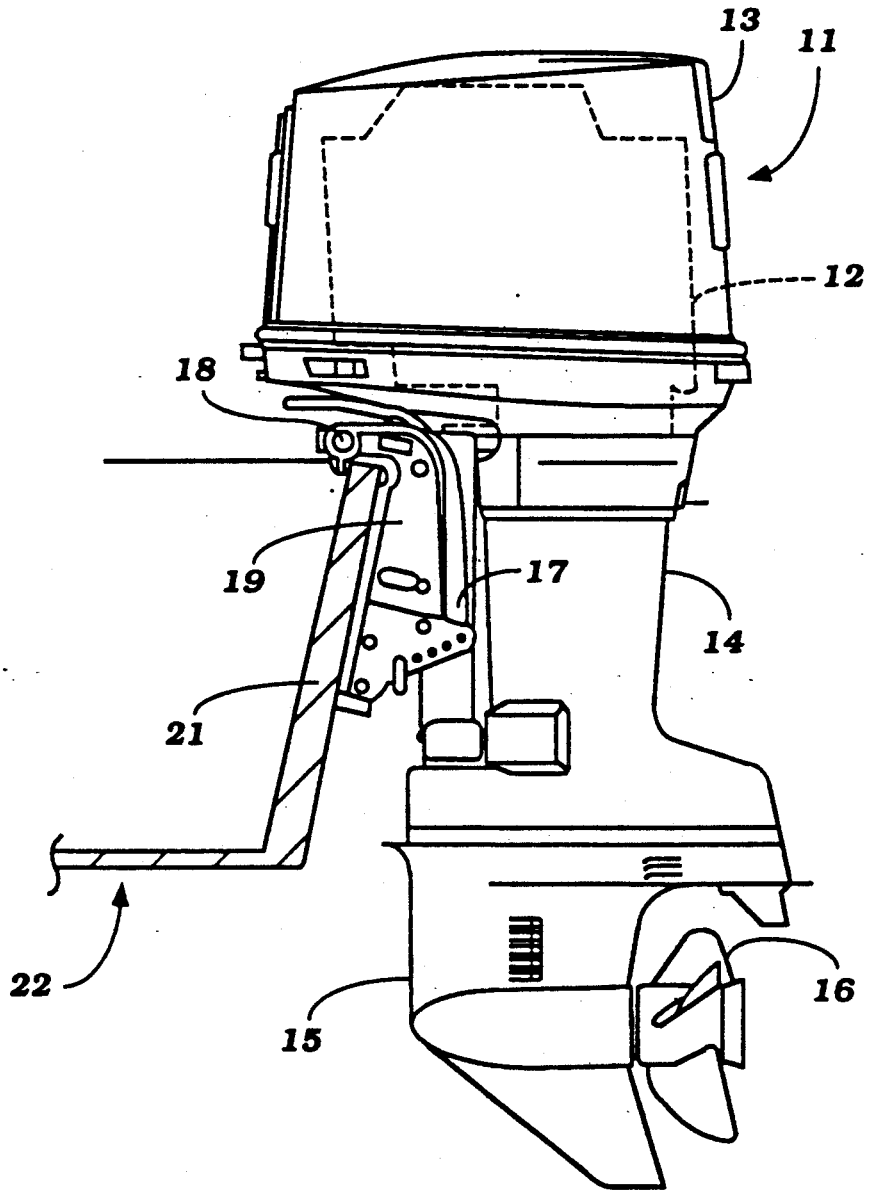
FIG. 1 is a side elevational view of an outboard motor embodying this invention and attached to the transom of an associated watercraft, shown partially and in cross section.

Referring first to FIG. 1, an outboard motor constructed in accordance with an embodiment of the invention is identified generally by the reference numeral 11 The invention is described in conjunction with an outboard motor 11 because such devices normally employ internal combustion engines having magneto ignition systems that require a kill switch for their stopping. It is to be understood, however, that the invention can be utilized in conjunction with a wide variety of other applications for internal combustion engines.

The outboard motor 11 includes a power head having an internal combustion engine 12 surrounded by a protective cowling 13. As is typical in outboard motor practice, the engine 12 is disposed so that its output shaft, in this case a crankshaft, rotates about a vertically extending axis.

The engine output shaft is coupled to a drive shaft (not shown) that depends into and is journaled within a drive shaft housing 14 and which terminates in a lower unit 15. A forward, neutral, reverse transmission (not shown) is contained within the lower unit 15 for driving a propeller 16 in selected forward or reverse directions.

A steering shaft (not shown) is affixed to the drive shaft housing 14 and is journaled for steering movement of the outboard motor 11 about a vertically extending axis defined by a swivel bracket 17. The swivel bracket 17 is, in turn, pivotally connected by means of a pivot pin 18 to a clamping bracket 19. The clamping bracket 19 provides means for attaching the outboard motor 11 to a transom 21 of an associated watercraft 22. The construction of the outboard motor 11 as thus far described may be considered to be conventional and, for that reason, further description of it is not believed to be necessary to enable those skilled in the art to practice the invention.

Figure 2:
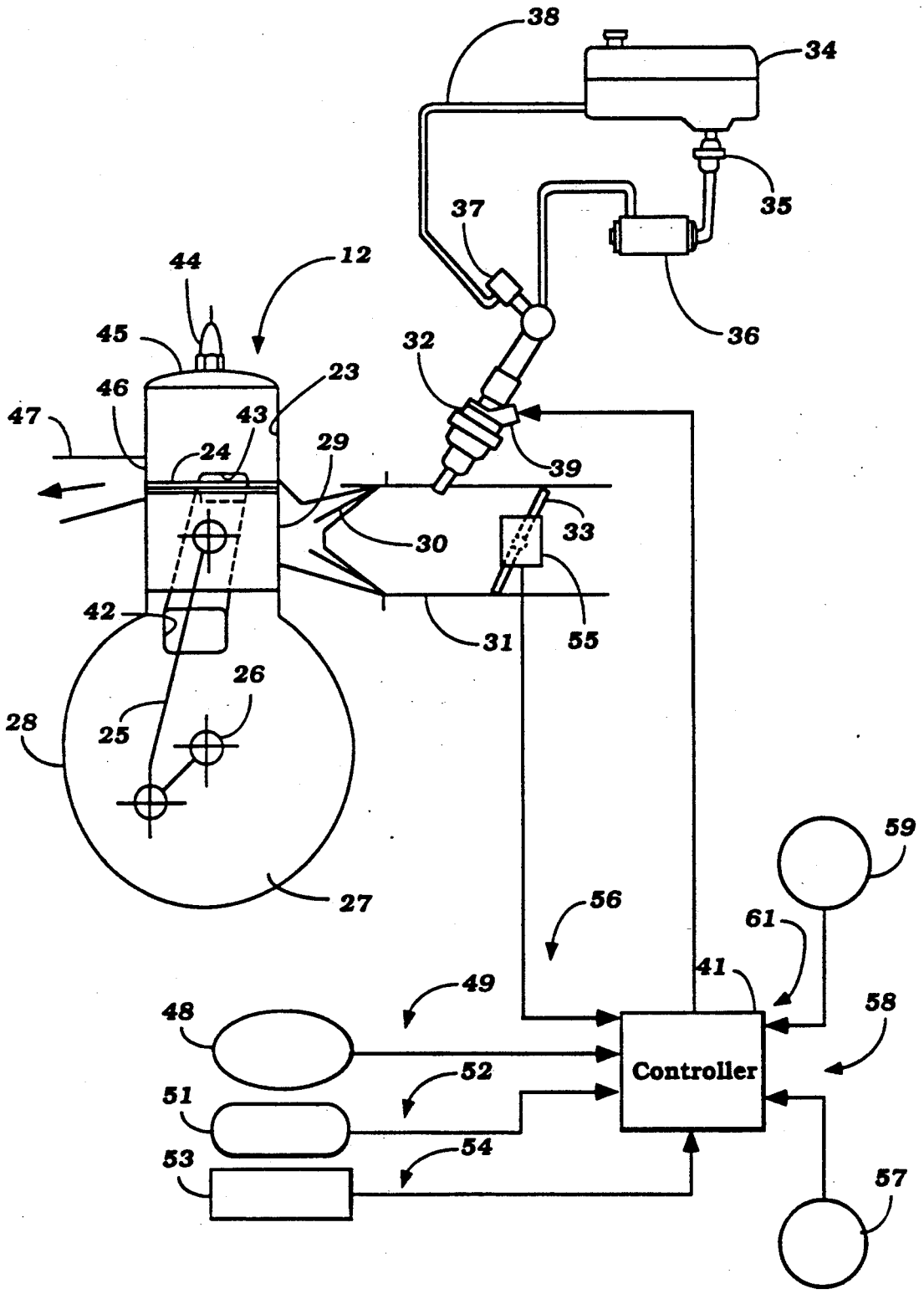
FIG. 2 is a schematic view showing the engine, the fuel supply system and the arrangement for precluding fuel supply during cranking when the kill switch is in its enabled position.

Referring now to FIG. 2, the engine 12 and particularly a single cylinder of it is shown in schematic cross section in order to explain the invention. Although only a single cylinder of the engine 12 is illustrated and described, it is believed readily apparent to those skilled in the art how to practice this invention with a multiple cylinder engine or to practice the invention with engines of the non reciprocating type such as rotary engines.

The engine 12 is, in the illustrated embodiment, described as operating on the two stroke crankcase compression principle. It is also believed to be readily apparent to those skilled in the art how the invention can be practiced in conjunction with engines operating on a four stroke principle.

The engine 12 includes a cylinder block that defines one or more cylinder bores 23 in which pistons 24 are supported for reciprocation. A connecting rod 25 connects the piston 24 to a crankshaft 26 that is supported for rotation within a crankcase chamber 27 formed in part by a crankcase 28.

A fuel/air charge is admitted to the crankcase chamber 27 by means of an intake port 29 which is served by an intake passage 31. A reed type check valve 30 is positioned between the intake passage 31 and the intake port 29 for precluding reverse flow during such times as the piston 24 is pressurizing the crankcase chamber 27.

A fuel injector nozzle 32 of the electronically controlled type discharges into the intake passage 31 upstream of the check valve 30. A throttle valve 33 which is manually operated is positioned in the intake passage 31 upstream of the fuel injection nozzle 32 for controlling the speed of the engine.

Fuel is supplied to the fuel injection nozzle 32 from a remotely positioned fuel tank 34 through a conduit in which a filter 35 is positioned. A fuel pump 36, which may be driven by the engine, delivers fuel under pressure to the injection nozzle 32. A pressure regulating valve 37 limits the pressure supply to the fuel injection nozzle 32 and excess fuel is returned to the fuel tank 34 through a return line 38 so as to achieve this pressure regulation.

The injector nozzle 32 has an electrically controlled element 39 which controls the amount and timing of the discharge of the fuel from the injection nozzle 32 to the induction passage 31 under the operation of a controller 41. The fuel/air mixture which is delivered to the crankcase chamber through the intake port 29 is compressed and then is transferred through one or more scavenge passages 42 and scavenge ports 43 to the area above the piston 24 at the appropriate time in the engine cycle. A spark plug 44 is contained within the cylinder head 45 and fires this charge at the appropriate time. The burnt charge is then exhausted through an exhaust port 46 and exhaust manifold 47 and suitable exhaust system contained within the outboard motor 11.

The engine 12 is provided with a flywheel magneto 48 for firing the spark plug 44 in a known manner. In addition, the flywheel magneto 48 has associated with it an appropriate circuit that outputs a signal 49 that is indicative of engine speed to the controller 41. The engine is provided with a kill switch 51 for stopping the engine. The kill switch 51 has a sensor associated with it that outputs a signal 52 indicative of condition of the kill switch to the controller 41. There is further provided a starter 53 for the motor 12 and the starter 53 has associated with it an indicator circuit 54 that outputs a signal to the controller 41 indicative of the operation of the starter 53.

There are also provided certain indicators of engine condition including a throttle position sensor 55 that is associated with the throttle valve 33 and which outputs a signal 56 indicative of throttle valve position or air flow to the controller 41. The engine is also provided with a temperature sensor 57 which outputs a temperature signal 58 to the controller 41. In addition to the controls and sensors already described, the outboard motor 11 may also be provided with a trim position sensor 59 that outputs a trim signal 61 to the controller 41.

Figure 3:
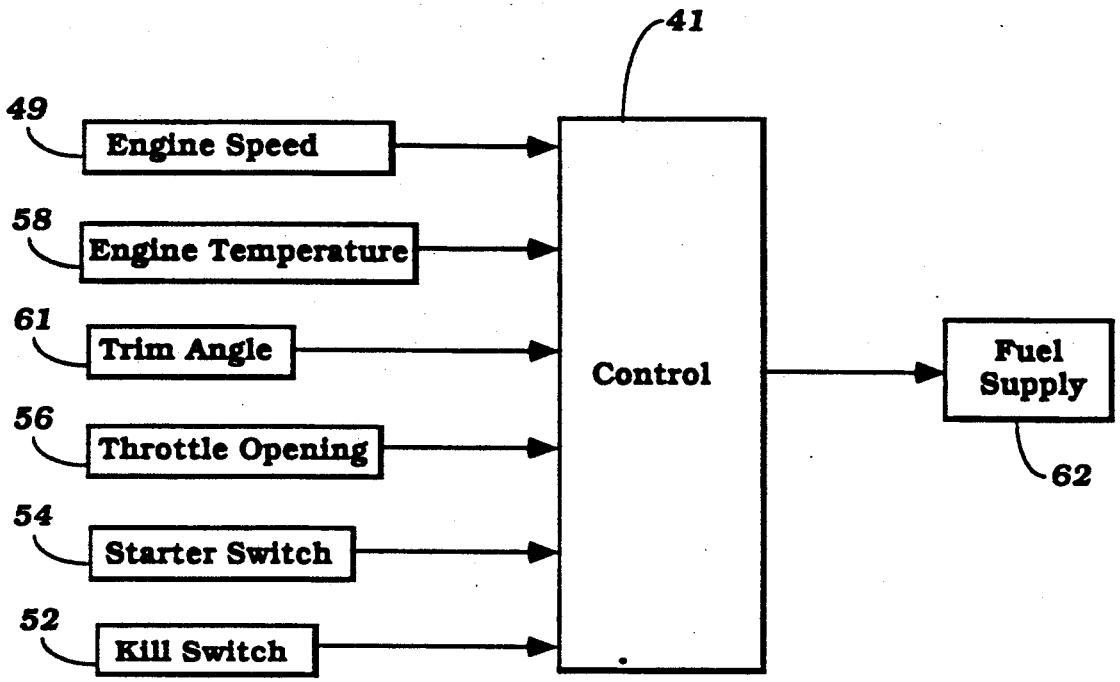
FIG. 3 is a block diagram showing the interrelationship of the various controls.
Figure 4:
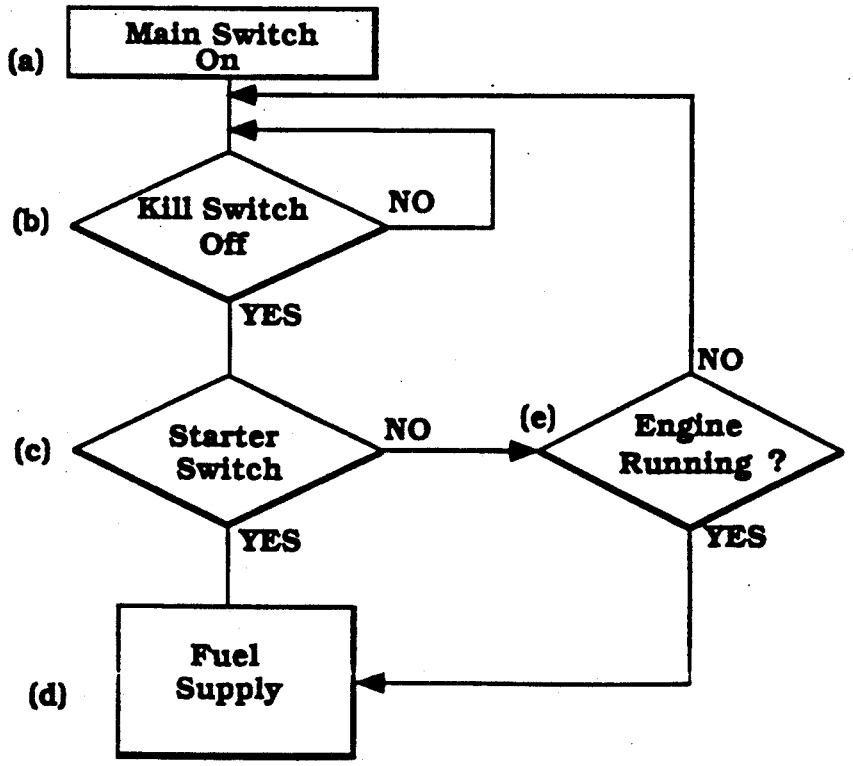
FIG. 4 is a block diagram showing the routine under which the invention operates.

Referring now in detail to FIGS. 3 and 4, the relationship of the various signals and controls to the controller 41 and its operation on the fuel system, indicated by schematically at 62 will be described. It should be noted that during normal engine running, the fuel supply 62 is provided with an amount of fuel that has been mapped into the controller 41 in relation to such parameters as engine speed 49, trim angle 61, throttle opening 56 and engine temperature 58. In addition, the starter switch 54 may initiate a control for providing additional fuel both during cranking and until the engine has been warmed up.

However, in addition to the aforenoted features, which may be considered to be conventional for the purpose of this application, the controller 41 also operates so as to disable the fuel supply system 62 when the engine starter 53 is being cranked and there is a starter signal 54 and the kill switch 51 is in its enabled position so as to provide an output signal 52. This routine may be understood by reference to FIG. 4.

The program begins at the step a when the main switch is turned on and moves to the step b to determine if the kill switch has been turned off. If the kill switch has not been turned off, the program repeats so that no fuel can be supplied to the engine until it is determined at least that the kill switch is turned off.

If, however, it is determined at the step b that the kill switch has been turned off, then the program moves to the step c to determine if the starter switch has been enabled. If the starter switch has been enabled, then the program moves to the step d to provide fuel to the engine in accordance with the aforenoted parameters. If, however, at the step c it is determined that the starter switch is not enabled, then the program moves to the step e to determine if the engine is running or not. If the engine is not running, the program moves back to the step b. If, however, it is determined that the engine is running, then the program moves to the step d to enable the fuel supply and provide fuel in accordance with the program of the controller. As a result, it should be readily apparent that fuel cannot be supplied to the engine until both the kill switch is turned off and the starter switch has been enabled and/or the engine is running.

Figure 5:
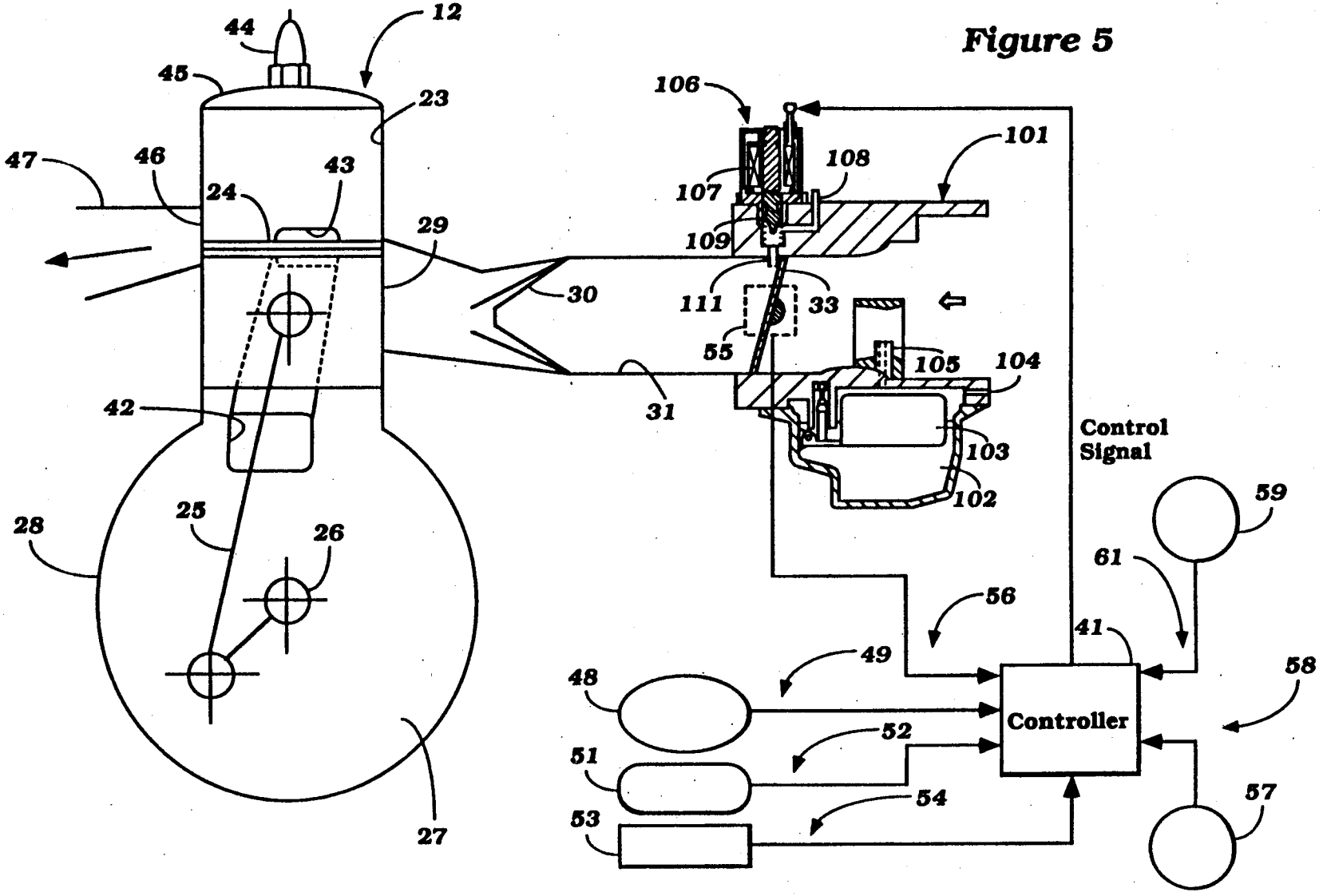
FIG. 5 is a schematic view, in part similar to FIG. 2, showing the invention as applied to a carbureted engine having an electrically operated enrichment mechanism for starting.

The embodiment just described is related to an engine having an electronically controlled fuel injection system. However, the invention can also be utilized in conjunction with a carburetion system. Such an embodiment is shown in FIG. 5. Since the engine 12 and many of the components associated with it except for the charge former and the control mechanism is generally the same, those components have been identified by the same reference numerals and will not be described again, except as may be necessary to understand the construction and operation of this embodiment.

In this embodiment, a carburetor is indicated generally by the reference numeral 101 and includes an induction passage shown schematically again at 31 in which a throttle valve 33 is positioned. The carburetor 101 has a fuel bowl 102 in which a constant head of fuel is controlled by a float operated valve 103. An air vent 104 vents the fuel bowl 102 and the fuel bowl 102 supplies an idle and transition discharge circuit (not shown) and a main fuel nozzle 105. In this regard, the carburetor may be considered to be conventional.

The fuel bowl 102 further supplies an electrically operated enrichment mechanism indicated generally by the reference numeral 106 which has an operating solenoid 107 controlled by the controller 41. Fuel is supplied to the starter device 106 through a conduit 108 from the fuel bowl 102. The solenoid 107 operates a needle type valve 109 so as to selectively open and close a discharge passage 111. When the discharge passage 111 is opened due to energization of the solenoid 107 as shown in FIG. 5, then enrichment fuel will be supplied to the engine. The controller may operate so as to provide priming fuel for starting and enrichment fuel until the engine has warmed up. In addition, if desired, the enrichment device 106 may also provide additional fuel for such conditions as acceleration or high speed running. Of course, all of these controls can be appropriately programmed into the controller 101.

As with the embodiment previously described and in accordance with the routine shown in FIG. 4, the enrichment device 106 will be enabled unless the kill switch is off and either the starter switch has been turned on or the engine is running. As a result, the device will provide appropriate enrichment when required but will insure that fuel cannot be supplied to the engine when the engine is being cranked and the kill switch has been enabled.

It should be readily apparent from the foregoing description that the embodiments of the invention are particularly adapted to insure that fuel is not wasted, the battery is not depleted and that cranking of the engine when the kill switch is enabled will be precluded. Although two embodiments of the invention have been illustrated and described, various changes and modifications may be made without departing from the spirit and scope of the invention, as defined by the appended claims.

I claim:

1. In an engine having a starter for cranking said engine for starting, a fuel supply system for supplying fuel to said engine for its running, an ignition system and a kill switch for stopping said engine by disabling said ignition system, the improvement comprising means for precluding the discharge of fuel from said fuel supply system when said starter is operated and said kill switch is in the engine stopping position.

2. In an engine as set forth in claim 1 wherein the fuel supply system includes a fuel injection nozzle.

3. In an engine as set forth in claim 2 wherein the means for precluding discharge of fuel precludes actuation of the fuel injection nozzle.

4. In an engine as set forth in claim 1 wherein the fuel supply system includes a carburetor.

5. In an engine as set forth in claim 4 wherein the carburetor has an enrichment system for supplying enrichment fuel during starting and the discharge of enrichment fuel is precluded when the starter is operated and the kill switch is in its engine stopping position.

6. The method of operating an engine having a starter for cranking the engine upon starting, a fuel supply system for supplying fuel to the engine for its running, an ignition system and a kill switch for stopping the engine by disabling said ignition system comprising the steps of sensing when the starter is operated, sensing when the kill switch is in its engine operating position and precluding the discharge of fuel when the starter is operated and the kill switch is in its engine stopping position.

7. The method of operating an engine as set forth in claim 6 wherein the fuel supply system comprises a fuel injection system.

8. The method of operating an engine as set forth in claim 6 wherein the fuel supply system includes a carburetor.

9. The method of operating an engine as set forth in claim 8 wherein the carburetor includes an enrichment system for supplying enrichment fuel during the starting of the engine and the enrichment system is disabled from discharging fuel when the kill switch is in its engine stopping position.

* * * * *